US007325631B2

(12) United States Patent
Roberts et al.

(10) Patent No.: US 7,325,631 B2
(45) Date of Patent: Feb. 5, 2008

(54) MILL AND PUMP-OFF SUB

(75) Inventors: William M. Roberts, Tomball, TX (US); Tracy R. Speer, Tyler, TX (US)

(73) Assignee: Smith International, Inc., Houston, TX (US)

( * ) Notice: Subject to any disclaimer, the term of this patent is extended or adjusted under 35 U.S.C. 154(b) by 347 days.

(21) Appl. No.: 11/193,538

(22) Filed: Jul. 29, 2005

(65) Prior Publication Data

US 2007/0023188 A1 Feb. 1, 2007

(51) Int. Cl.
*E21B 43/11* (2006.01)

(52) U.S. Cl. ..... 175/300; 166/298; 166/55

(58) Field of Classification Search ..... None
See application file for complete search history.

(56) References Cited

U.S. PATENT DOCUMENTS 4,716,976 A * 1/1988 Isakov ..... 175/426
5,186,265 A * 2/1993 Henson et al. ..... 175/107
5,271,472 A * 12/1993 Leturno ..... 175/107
5,472,057 A * 12/1995 Winfree ..... 175/57
5,671,818 A * 9/1997 Newton et al. ..... 175/393
6,564,886 B1 * 5/2003 Mensa-Wilmot et al. ... 175/331
6,877,570 B2 * 4/2005 Chen et al. ..... 175/22
7,108,084 B2 * 9/2006 Vail, III ..... 175/57

* cited by examiner

*Primary Examiner*—Frank Tsay
(74) *Attorney, Agent, or Firm*—Osha Liang LLP

(57) ABSTRACT

A downhole mill includes a plurality of cutters extending generally radially from a center region to a gage diameter, wherein the plurality of cutters includes a first serrated cutter blade having a plurality of peaks and valleys along its length. The plurality of cutters includes a second serrated cutter blade having a plurality of peaks and valleys along its length. The plurality of cutters includes a non-serrated cutter blade positioned upon the cutting face between the first serrated cutter blade and the second serrated cutter blade, wherein the peaks of the first serrated cutter blade is radially aligned with the valleys of the second serrated cutter blade. A pump-off sub configured to release a downhole mill includes a dovetail connection maintained by a c-ring in an expanded state.

43 Claims, 7 Drawing Sheets

MILL AND PUMP-OFF SUB

FIELD OF THE INVENTION

The invention relates generally to a downhole mill. More particularly, the invention relates to a downhole mill to drill out a bridge plug. More particularly still, the invention relates to a downhole mill having a plurality of serrated cutters and non-serrated cutters to drill out a bridge plug.

BACKGROUND OF INVENTION

Downhole mills are used in oilfield operations to perform a variety of tasks. Typically, downhole mills include rotary cutters with hardened cutting surfaces used primarily to cut or grind material (e.g. metal, plastic, composite, etc.) at various downhole locations. In contrast, a downhole drill bit is typically used to cut the rock or downhole formation. Mills, in comparison, are run down the borehole to cut man-made obstructions so that further operations can proceed.

Some downhole mills are used to cut sidetrack windows into a cased portion of the borehole. With a side track window properly milled, a subsequent run with a drill bit can proceed out of the cased wellbore through the milled window to create a deviated bore. Furthermore, downhole mills are useful in the removal of various downhole obstructions, commonly referred to in the petroleum recovery industry as "junk." Junk mills are frequently used to clean out various metallic and non-metallic obstructions that may exist within a string of casing or tubing. Particularly, the junk can include various objects accidentally dropped downhole from the surface (e.g. hand tools, wrenches, etc), components of drilling apparatuses (e.g. drill bit teeth, nozzles, etc.) that have broken off, or accumulated cement or other sediment left behind from previous downhole operations. In each case, the downhole mill is typically delivered to the location of interest upon a distal end of a work string so that the cutting head of the mill is rotated and axially (or, in the case of side-track mills, radially) loaded against the material to be cut.

Often, permanent devices are placed downhole that must be milled out if their removal becomes necessary. One example of such a device is a bridge plug; a device set downhole to isolate a lower region of a wellbore from an upper region. Typically, the lower region being isolated is a production zone, wherein the bridge plug is set either to prevent production fluids from escaping the production zone or to prevent fluids from a treatment operation from invading the production zone. When the removal of a bridge plug is desired, a milling operation can be performed. During such an operation, a mill is deployed at a distal end of a work string and the bridge plug is ground out. After the mill has progressed deep enough into the bridge plug, it can be retrieved either at the end of the work string or in a later, subsequent retrieval operation. One such drillable bridge plug is disclosed in U.S. patent application Ser. No. 11/064,306, filed on Feb. 23, 2005, entitled Drillable Bridge Plug, hereby incorporated by reference herein.

SUMMARY OF INVENTION

According to one aspect of the present invention, a downhole mill includes a mill body providing a cutting face, a rotation axis, and a gage diameter. The downhole mill also includes a plurality of cutters positioned upon the cutting face, wherein each cutter extends generally radially from a center region of the cutting face to the gage diameter. Preferably, the plurality of cutters includes a first serrated cutter blade having a plurality of peaks and valleys along its length, a second serrated cutter blade having a plurality of peaks and valleys along its length, and a non-serrated cutter.

According to another aspect of the present invention, a downhole mill includes a mill body providing a cutting face, a rotation axis, and a gage diameter. The downhole mill also includes a plurality of cutters positioned upon the cutting face, wherein each cutter extends generally radially from a center region of the cutting face to the gage diameter. Preferably, the plurality of cutters includes a first serrated cutter blade having a plurality of peaks and valleys along its length, a second serrated cutter blade having a plurality of peaks and valleys along its length, and a non-serrated cutter blade positioned upon the cutting face between the first serrated cutter blade and the second serrated cutter blade, wherein the peaks of the first serrated cutter blade are radially aligned with the valleys of the second serrated cutter blade when the cutting head is rotated about the rotation axis.

According to another aspect of the present invention, a pump-off sub configured to release a downhole mill includes a dovetail connection between the pump-off sub and the downhole mill, wherein the dovetail connection is maintained by a c-ring in an expanded state. The pump-off sub also includes a latch mandrel slidably engaged within a bore of the downhole mill, wherein the latch mandrel is configured to maintain the c-ring in the expanded state with a radial upset. Furthermore, the latch mandrel preferably includes a receptacle into which the c-ring is configured to collapse when in a collapsed state, and wherein the c-ring progresses from the expanded state to the collapsed state when the latch mandrel is axially displaced by a ball dropped down the bore of a work string connected to a proximal end of the pump-off sub.

According to another aspect of the present invention, a pump-off sub configured to release a downhole mill includes a detachable connection between the pump-off sub and the downhole mill, wherein the detachable connection is maintained by a c-ring in an expanded state. The pump-off sub also includes a latch mandrel slidably engaged within a bore of the pump-off sub, wherein the latch mandrel is configured to maintain the c-ring in the expanded state with a radial upset. Furthermore, the latch mandrel preferably includes a receptacle into which the c-ring is configured to collapse when in a collapsed state, wherein the c-ring progresses from the expanded state to the collapsed state when the latch mandrel is axially displaced by a ball dropped down the bore of a work string connected to a proximal end of the pump-off sub.

According to another aspect of the present invention, a method to remove a downhole obstruction with a mill includes connecting the mill to a distal end of a pump-off sub and deploying the pump-off sub and connected mill to the downhole obstruction upon a distal end of a work string. The method also includes rotating and axially loading the mill against the downhole obstruction, dropping a weighted ball down the work string to disengage a latch mandrel and retract a c-ring of the pump-off sub, and axially loading the work string to separate the pump-off sub from the detached mill.

Other aspects and advantages of the invention will be apparent from the following description and the appended claims.

DETAILED DESCRIPTION

Figure 1:
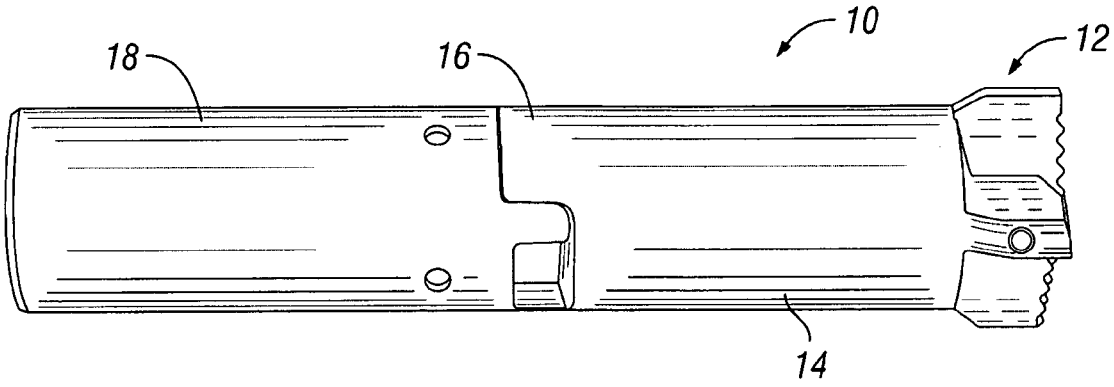
FIG. 1 is a profile view drawing of a mill assembly with a pump-off connection in accordance with an embodiment of the present invention.

Referring initially to FIG. 1, a mill assembly 10 is shown. Mill assembly 10 is shown as having a cutting head 12, a main body 14, and a rear end 16. While mill assembly 10 is shown having a pump-off sub connection 18 at its rear (i.e. proximal) end 16, it should be understood that a threaded pipe connection or any other connection means known in the art to connect mill assembly 10 to a work string (not shown) may be substituted instead. Furthermore, while mill assembly 10 is preferably configured to drill out a bridge plug (not shown), it should be understood that it can be used to perform any of a variety of drilling, milling, or grinding tasks.

Figure 2:
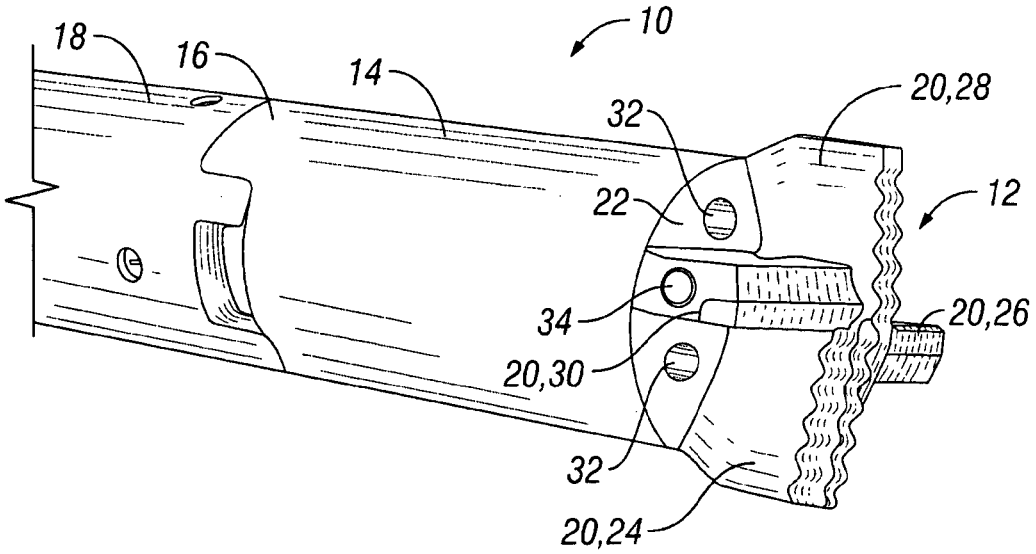
FIG. 2 is a close up isometric view of the mill assembly of FIG. 1.

Referring now to FIG. 2, the cutting head 12 of mill assembly 10 is more clearly visible. Cutting head 12 preferably includes a plurality of cutting blades 20 arranged upon a cutting face 22. While four blades 20 are shown in FIG. 2, it should be understood that any number of blades 20 can be used without departing from the intent of the present invention. Particularly, FIG. 2 discloses a four blade 20 arrangement, wherein two blades 24, 28 have serrated cutting surfaces and two blades 26, 30 have non-serrated cutting surfaces. Furthermore, a plurality of fluid ports 32 are located on cutting face 22 adjacent to blades 20 to allow cutting fluids from an internal bore of a work string and main body 14 to communicate with, lubricate, and carry particles away from cutting blades 20.

Additionally, a plurality of hardened buttons 34 are depicted located around the periphery of cutting head 12 at the radial ends of each cutting blade 24, 26, 28, and 30. Hardened buttons 34, manufactured of any appropriate hardened material, including, but not limited to tungsten carbide, help define and maintain the drilling diameter, or gage, drilled by cutting head 12. In operation, hardened buttons 34 press against the milled bore when mill assembly 10 rotates, stabilizing cutting head 12 within the material being milled.

Figure 3:
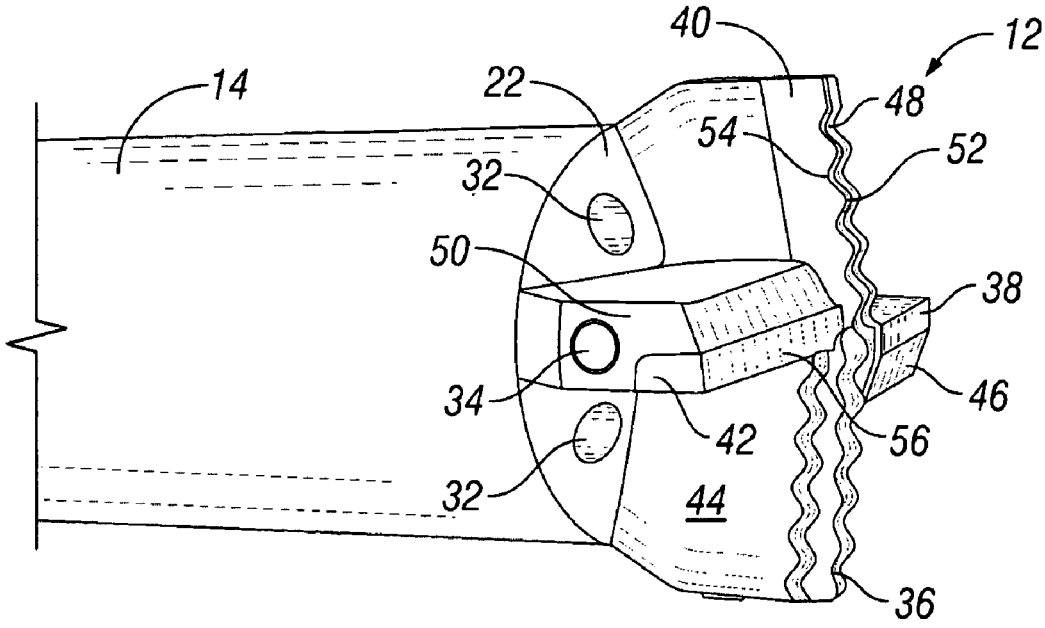
FIG. 3 is a close up isometric view of a cutting head of the mill assembly of FIG. 1.

Referring now to FIG. 3, a close up view of a cutting head 12 in accordance with an embodiment of the present invention is shown. As shown in FIG. 2, cutting head 12 includes a plurality of fluid ports 32 to communicate drilling fluids to cutting face 22 and cutter blades (24, 26, 28, and 30 of FIG. 2) as well as a plurality of hardened button inserts 34 to establish a gage diameter for cutting head 12. Furthermore, in viewing FIG. 3, it can be seen that each cutter blade (20 of FIG. 2) is actually comprised of a plurality of cutter inserts 36, 38, 40, and 42 brazed (or otherwise securely mechanically attached) into a plurality of cutter receptacles 44, 46, 48, and 50.

Cutter inserts 36 and 40 are shown constructed as serrated cutters, each having a plurality of peaks 52 and valleys 54 and cutter inserts 38 and 42 are shown as non-serrated cutters, each having a non-serrated cutting edge 56. Cutter inserts 36, 38, 40, and 42 can be constructed of any hardened material suitable for cutting the material to be milled, but in one embodiment may be constructed of sintered tungsten carbide. In addition, cutter receptacles 44, 46, 48, and 50 may be constructed from any material suitable for downhole use, but in this embodiment are constructed from the same material (e.g. steel, stainless steel, nickel alloy, etc.) as main body 14. It should be noted that cutter receptacles 44, 46, 48, and 50 can either be constructed as non-serrated receptacles (46, 50) or as serrated receptacles (44, 48). While it is disclosed that serrated receptacles 44, 48 are used with serrated cutter inserts 36, 40, and non-serrated receptacles 46, 50 are used with non-serrated cutter inserts 38, 42, no such correlation is required by the present invention. Furthermore, while the height of receptacles 44, 46, 48, and 50 is shown slightly lower than their corresponding cutter inserts 36, 38, 40, and 42, it should be understood that the height of receptacles 44, 46, 48, and 50 can be equal, greater, or significantly lower than that of inserts 36, 38, 40, and 42. Finally, it should be understood that the geometry of the cutting faces of inserts 36, 38, 40, and 42 may be slightly raked back from front to back in order to facilitate long cutter life and high penetration rates. Rake angles of 7° for serrated cutters 36, 40 and 18° for non-serrated cutters 38, 42 are disclosed, but are not necessary.

Figure 4:
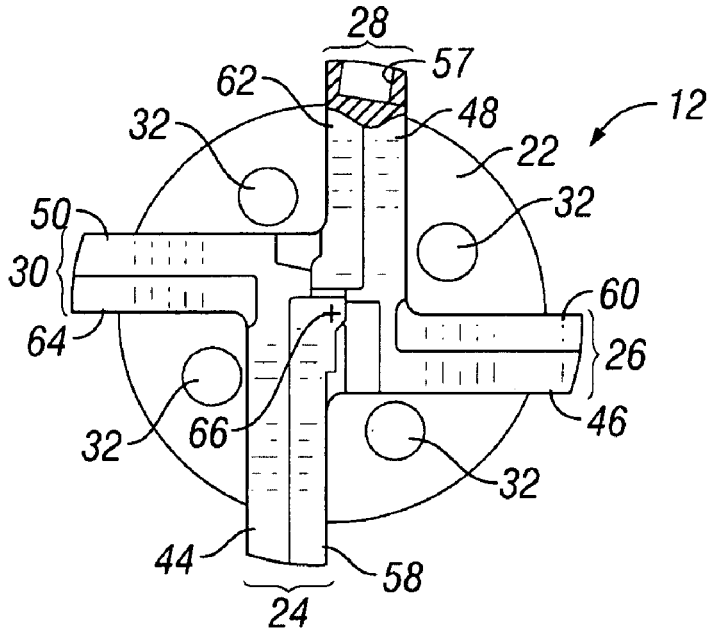
FIG. 4 is a schematic end view drawing of a cutting head in accordance with an embodiment of the present invention.

Referring now to FIG. 4, a schematic of the cutting head 12 is shown. Cutting head 12 includes four cutter blades 24, 26, 28, and 30, each containing a receptacle 44, 46, 48, and 50 configured to receive a hardened button 34, and extending from cutting face 22. As can be seen, each cutter receptacle 44, 46, 48, and 50 includes a pocket 58, 60, 62, and 64 into which a cutter insert (36, 38, 40, and 42 of FIG. 3) is mechanically mounted. Additionally, each cutter blade 24, 26, 28, and 30, may include a socket 57 for a hardened gauge insert at its distal end. Furthermore, a rotation axis 66 for cutting head 12 is indicated.

Because of the relative thickness of cutter blades 24, 26, 28, and 30 with respect to the diameter of cutter head 12, not every blade can exist upon central axis 66. In the embodiment disclosed in FIG. 4, only blade 26 (and corresponding mounting pocket 58) exists upon central axis 66 of cutting head 12. Therefore, it should be understood that a center region (not shown) exists such that the ends of cutter blades 24, 26, 28, and 30 proximal to center axis 66 are all contained therein. Furthermore, it should be understood that because of these geometric limitations, blades 24, 26, 28, and 30 extend generally (but not actually) radially from this center region to a gage diameter of cutting head 12. To compensate for this generally radial arrangement, blades 24, 26, 28, and 30 are manufactured of differing lengths such that the distance between their distal ends and central axis 66 is substantially equal.

Figure 5:
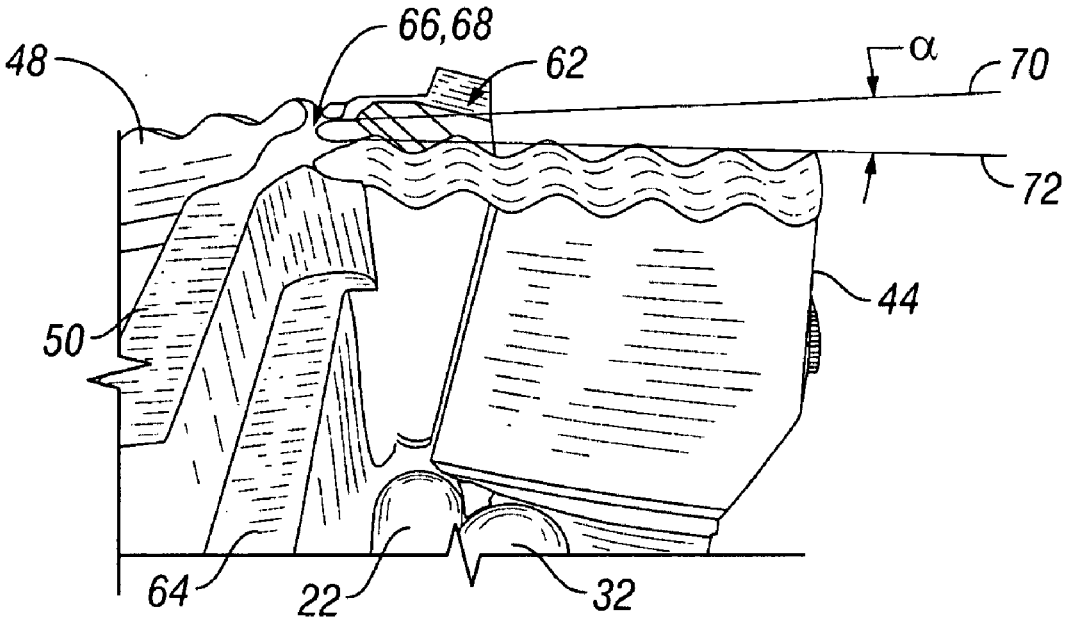
FIG. 5 is a close up isometric view of the cutting head of FIG. 3 with the cutter blades removed.

Referring now to FIG. 5, cutting head 12 is shown so that an angle of declination α is shown. Angle of declination α is defined as the angle between a plane 70 located 90° to rotation axis 66 at a center point 68 of cutting head 12 and a radial axis 72 of cutter blades 24, 26, 28, and 30. While declination angle a is shown as a positive, it should be understood that cutting head 12 can be constructed such that declination angle α is zero or negative. Positive values for α indicate a concave configuration for blades and negative values α indicate a convex configuration. Positive declination angles α are believed to assist mill assembly in locating and following a trajectory for certain operations.

As shown in FIGS. 2-5, the disclosed arrangement for cutter blades 24, 26, 28, and 30 includes locating non-serrated blades 26, 30 between serrated blades 24, 28. Furthermore, it should be understood that rates of penetration and cutter wear can be improved by a scheme to equalize the amount of cutting performed by each cutting surface of serrated cutter blades 24 and 28. Such a scheme includes, but is not limited to the arrangement of serrated cutter blades 24 and 28 such that when the blades are rotated about the rotation axis 66, peaks of blade 24 radially align with valleys of blade 28 and valleys of blade 24 radially align with peaks of blade 28. Furthermore, testing indicates that varying relative heights of serrated blades 24 and 28 with respect to non-serrated blades 26 and 30 may produce optimal rates of penetration. While non-serrated blades 26 and 30 are depicted in FIGS. 2-5 approximately 0.025-0.050" lower in height than adjacent serrated blades 24, 28, it should be understood that heights equal or greater than serrated blades are possible.

Alternatively, the cutters 24, 26, 28, and 30 of the cutting head 12 depicted in FIGS. 1-5 can be arranged in a bi-centered scheme such that mill assembly 10 is capable of milling a bore larger than the smallest bore through which cutting head 12 can pass. Particularly, one or more of cutters 24, 26, 28, and 30 can be radially lengthened such that the extended blade(s) sweeps a larger radius than the remaining blades when rotated about axis 66. For example, by radially extending a single blade (24, 26, 28, or 30) of a 3.625" gage diameter cutting head outward by 0.125", a 3.75" sized cutting head capable of cutting a 3.875" bore is created.

Figure 6:
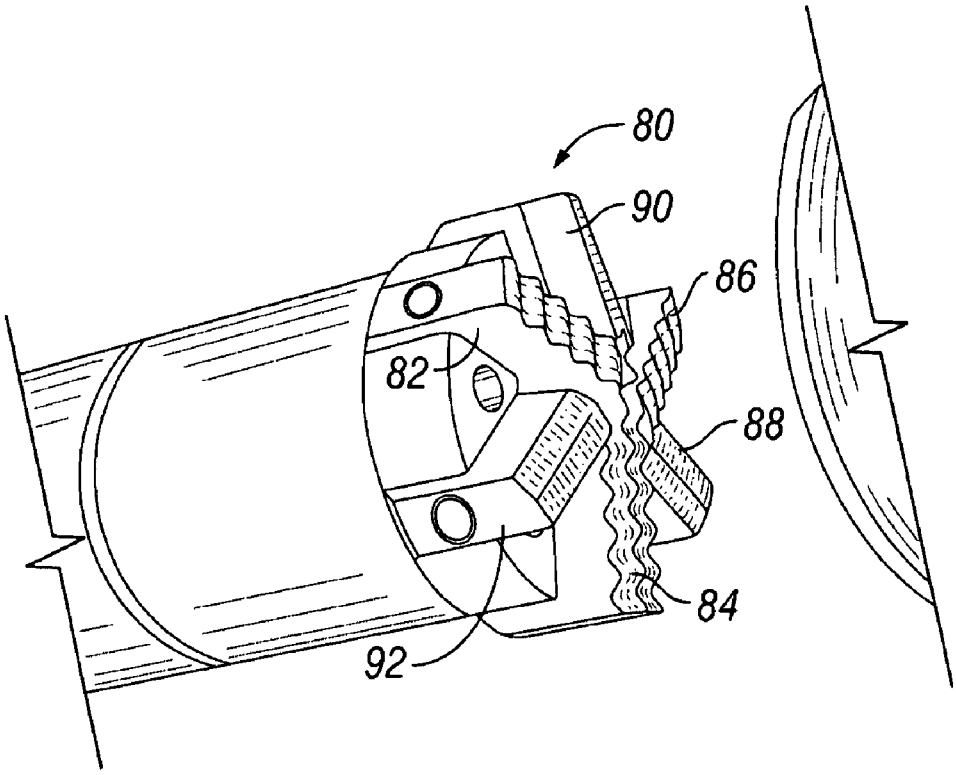
FIG. 6 is an isometric view of a cutting head assembly in accordance with an alternative embodiment of the present invention.

Referring briefly to FIG. 6, a cutting head 80 having six cutters (three serrated 82, 84, and 86, and three non-serrated 88, 90, and 92) is shown. While previously discussed embodiments (FIGS. 1-5) discloses a cutting head 12 having only four cutters, it should be understood that cutting heads employing any number of cutters can be used without departing from the scope of the present invention. The number of cutters used upon cutting heads in accordance with the present invention is limited only by the practicality associated with the respective sizes of the cutting head and cutters themselves.

Figure 7:
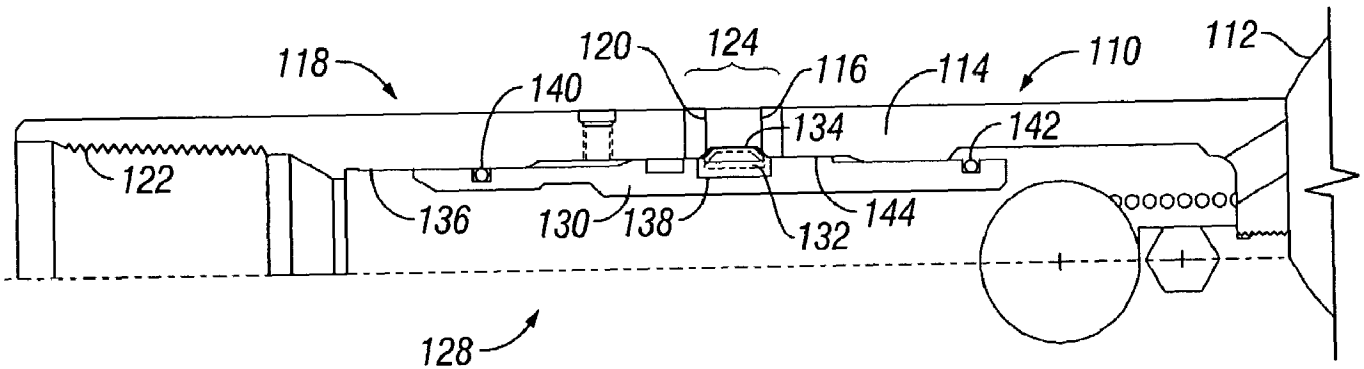
FIG. 7 is a sectioned view drawing of a pump-off sub in accordance with an embodiment of the present invention.

Referring now to FIG. 7, a combination mill assembly 110 and pump-off sub 118 is shown. Mill assembly 110 includes a cutting head 112, a main body 114, and a mating connection 116. While cutting head 112 is shown to be of similar construction as cutting head 12 of FIGS. 1-5, it should be understood that any cutting head may be used. Pump-off sub 118 includes a corresponding mating connection 120 at its distal end and a work string connection 122 at its proximal end. While a standard threaded connection is depicted for work string connection 122, it should be understood that any type of work string connection may be used.

In a manner similar to that depicted in FIG. 1, mating connection 116 and corresponding mating connection 120 join together to form a rotary dovetail joint 124 joining mill assembly 110 and pump-off sub 118 together. Unassisted, dovetail connection 124 allows for the transmission torque loads and compressive axial loads from pump-off sub 118 to mill assembly 110, but does not allow for the transmission of axial tensile loads. The ability of dovetail connection 124 to carry tensile loads is controlled by a latch mechanism 128 that is deployed downhole in an engaged state and is releasable from the surface when separation of pump-off sub 118 from mill assembly 110 is desired.

The releasable latch mechanism 128 includes a latch mandrel 130, an expandable c-ring 132, and a c-ring profile 134. Latch mandrel 130 is configured to sit within a bore 136 of pump-off sub 118 and mill assembly 110 and includes a receptacle 138, a plurality of o-ring seals 140, 142, and a radial upset portion 144. To engage the latching mechanism 128, c-ring 132 is expanded with a pair of pliers or ring expanders until it is snug within corresponding profile 134 formed within dovetail joint 124. In FIG. 7, c-ring 132 is depicted by dashed lines in the relaxed state and solid lines in the expanded state. Once c-ring 134 is expanded, latch mandrel 130 is displaced toward work string connection 122 until upset portion 144 radially supports c-ring 132 in the expanded position.

Figure 8:
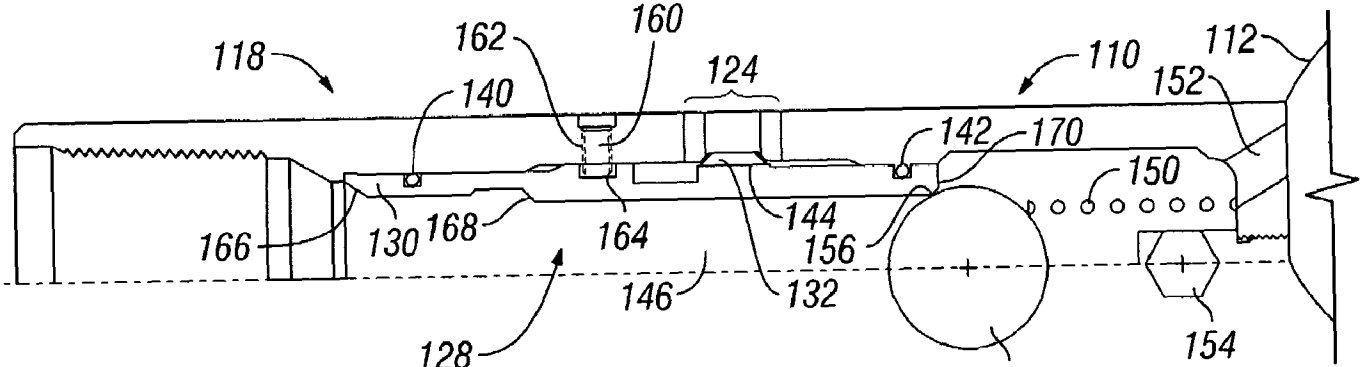
FIG. 8 is a sectioned view drawing of the pump-off sub of FIG. 7 in an assembled configuration.

Referring now to FIG. 8, latch mechanism 128 is shown in the engaged state, ready to be deployed downhole. C-ring 132 is shown in its energized and expanded state maintained by upset portion 144 of latch mandrel 130. With c-ring 132 in this position, tensile axial loads can be carried from pump-off sub 118 to mill assembly 110 through dovetail joint 124 without separation. O-ring seals 140, 142 prevent fluids from the borehole from entering an internal bore 146 of the combination mill assembly 110 and pump-off sub 118. A shear pin 160 is engaged through a port 162 of pump-off sub 118 and engages a corresponding profile 164 of latch mandrel 130 to prevent premature disengagement of latch mechanism 128. Furthermore, latch mechanism 128 and latch mandrel 130 are constructed so that the likelihood of premature unlatching is minimized. Latch mandrel 130 is preferably constructed to minimize exposed cross sectional area exposed to high pressure and high flow rate fluids flowing through bore 146. Particularly, inlet chamfer 166 and ball socket 168 are angled to limit the amount of drag force experienced by latch mandrel 130 to prevent movement thereof. Furthermore, as a leading edge 170 of latch mandrel 130 has substantially the same cross sectional area as the sum of chamfer 166 and socket 168, and is exposed to the same flow in bore 146, increases in pressure within bore 146 alone will not displace latch mandrel 130.

Finally, a check valve comprising a spherical ball element 148 and a compression spring 150 prevents fluids from entering bore 146 through fluid ports 152 communicating between bore 146 and cutter head 112. A mechanical ball stop 154 prevents ball element 148 from traveling too far towards cutter head 112 and a ball seat 156 forms a hydraulic seal with ball element 148, thereby preventing fluids from entering bore 146. Compression spring 150 should be selected such that pressure increases in bore 146 allow the displacement of ball element 148 so that drilling fluids can be communicated from bore 146 to cutter head 112 through fluid ports 152, when desired. The check valve characteristics of ball element 148 and ball seat 156 enable combination mill assembly 110 and pump-off sub 118 to be deployed downhole during a "snubbing" operation, where the well is pressurized and shut-in. Absent the check valve, well fluids could blow out of the well through the bore of a work string connected to connection 122.

Figure 9:
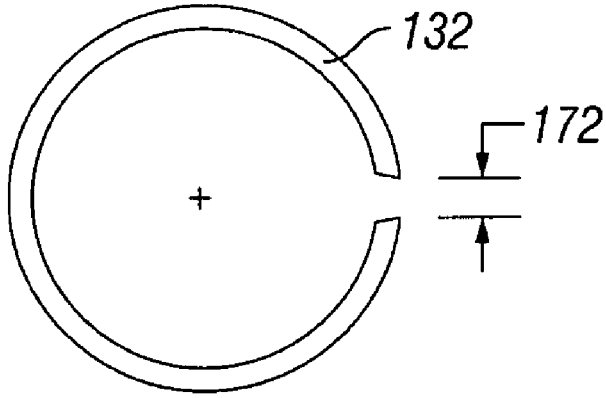
FIG. 9 is a plan view drawing of a retainer ring to be used with the pump-off sub of FIG. 7.
Figure 10:
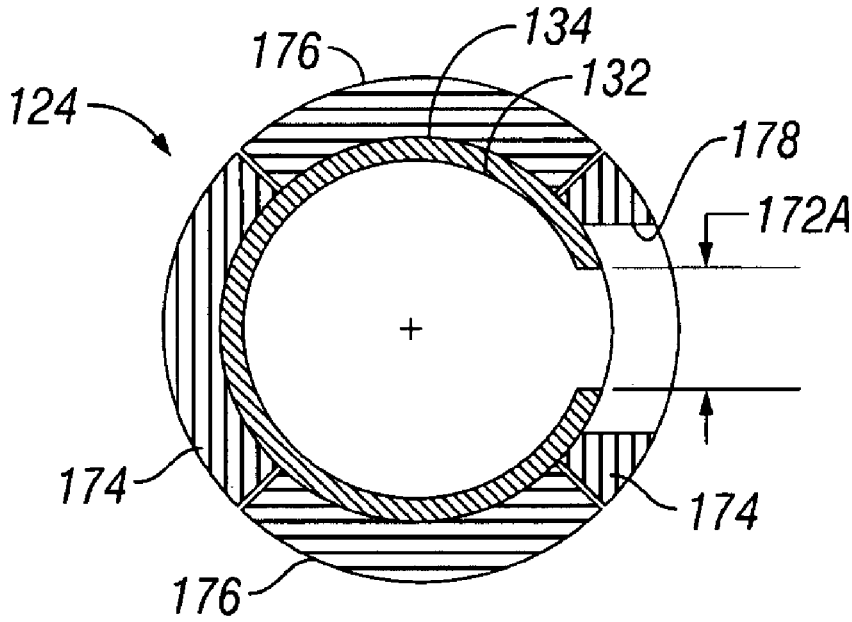
FIG. 10 is a sectioned view drawing of the retainer ring of FIG. 9 installed in the pump-off sub of FIG. 7.

Referring briefly to FIG. 9, a close-up view of c-ring 132 is shown in its relaxed, compressed state. In the relaxed state, c-ring 132 has a gap 172 allowing expansion of c-ring 132 when placed in profile 134 of dovetail joint 124 as shown in FIGS. 7 and 10. Referring now to FIG. 10, c-ring 132 is shown expanded within profile 134 of dovetail joint 124. Dovetail joint 124 includes two prongs 174 from cutter assembly 110 and two prongs 176 from pump-off sub 118. With c-ring 132 expanded and held in place by latch mandrel 130, axial loads are transferred between pump-off sub 118 and mill assembly 110 without separation. An aperture 178 within a prong 174 of dovetail joint 124 allows for the insertion of pliers or ring spreaders to expand c-ring 132 so that radial upset (144 of FIGS. 7-8) can be moved into position. While aperture 178 is shown within one prong 174 of cutter assembly 110, it should be understood that aperture 178 can be located within or adjacent to any prong 174, 176 of dovetail joint 124. Furthermore, while dovetail joint 124 shown in FIGS. 7, 8, and 10 includes four prongs 174, 176, other numbers are feasible.

Figure 11:
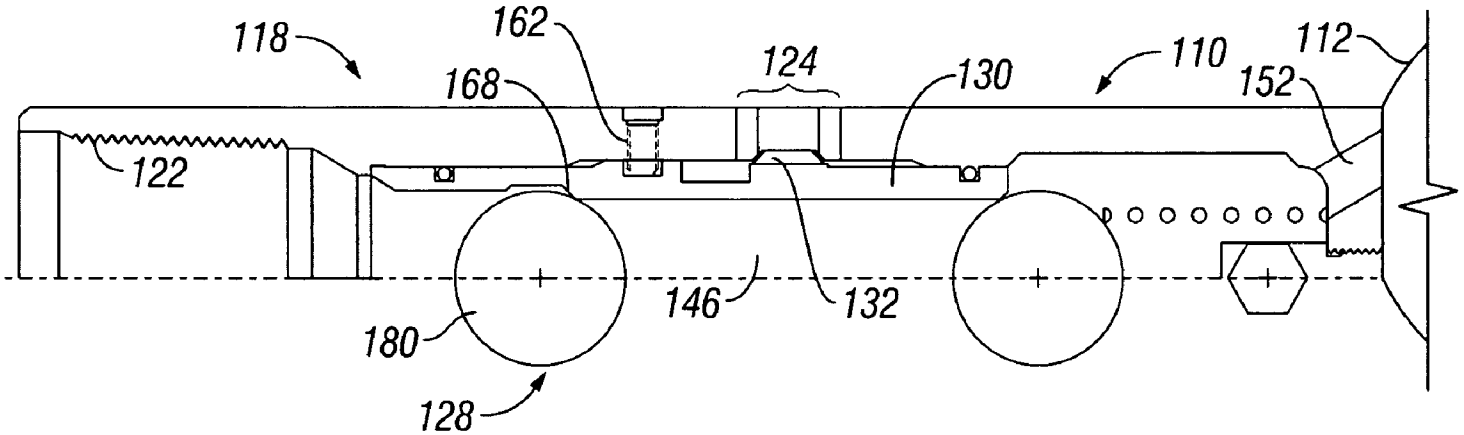
FIG. 11 is a sectioned view drawing of the pump-off sub of FIG. 7 immediately prior to disengagement of the mill.

Referring now to FIG. 11, the process for releasing latch mechanism 128 is shown. When it is desired to release mill assembly 110 from pump-off sub 118, a weighted ball 180 is dropped from the surface (or other location) down a work string connected to connection 122 and bore 146. Weighted ball 180 can be of any material, but is preferred to be constructed from a solid metallic (typically bronze) having a smooth spherical geometry. The weight of the material for ball 180 assists in its delivery to the latch mechanism 128 at the bottom of work string. Furthermore, by continuing to pump fluid through work string, bore 146, and out ports 152 to cutter head 112, the delivery of weighted ball 180 to latch mechanism 128 can be accelerated. Once weighted ball 180 reaches latch mechanism 128, it stops and seats against ball socket 168. Ball socket 168 can be of any geometry or configuration that hydraulically seals with weighted ball 180, but is preferably a corresponding profile. With weighted ball 180 seated against ball socket 168, pressure increases are transferred to latch mandrel 130 in relation to the cross-sectional area of weighted ball 180. Therefore, increases in pressure at work string impact significant thrust loads upon latch mandrel 130.

Figure 12:
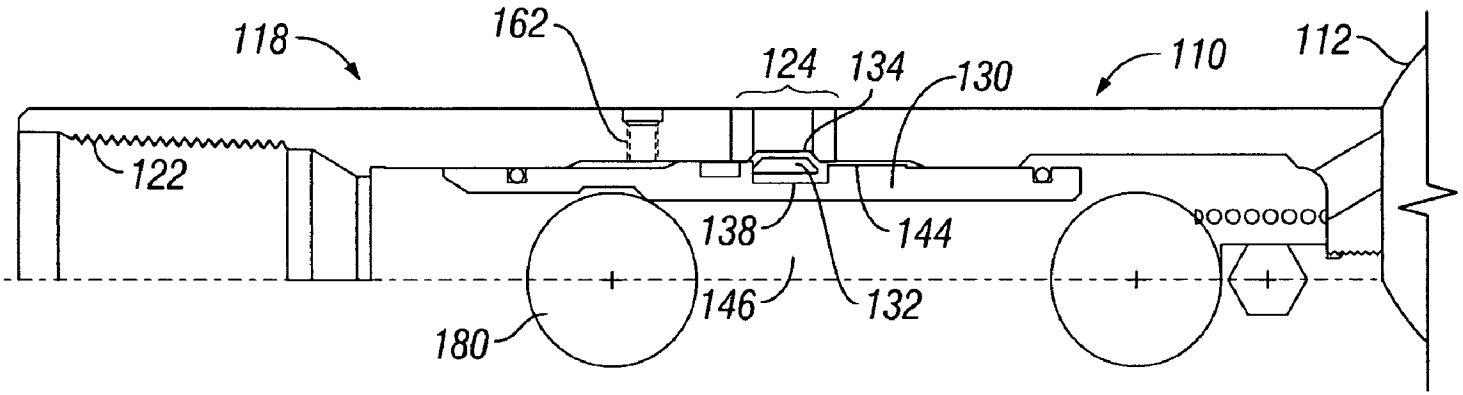
FIG. 12 is a sectioned view drawing of the pump off-sub of FIG. 7 immediately following disengagement.

Referring now to FIG. 12, increases in pressure applied to work string attached at connection 122 have loaded latch mandrel 130 by way of weighted ball 180 enough to shear through shear pins 162 and thrust latch mandrel 130 down bore 146. With latch mandrel 130 displaced, radial upset 144 no longer supports c-ring 132 in profile 134 and it is allowed to collapse into receptacle 138 of latch mandrel 130. With c-ring 132 disengaged from profile 134 of dovetail joint 124, pump-off sub 118 can separate from mill assembly 110 as shown in FIG. 13.

Figure 13:
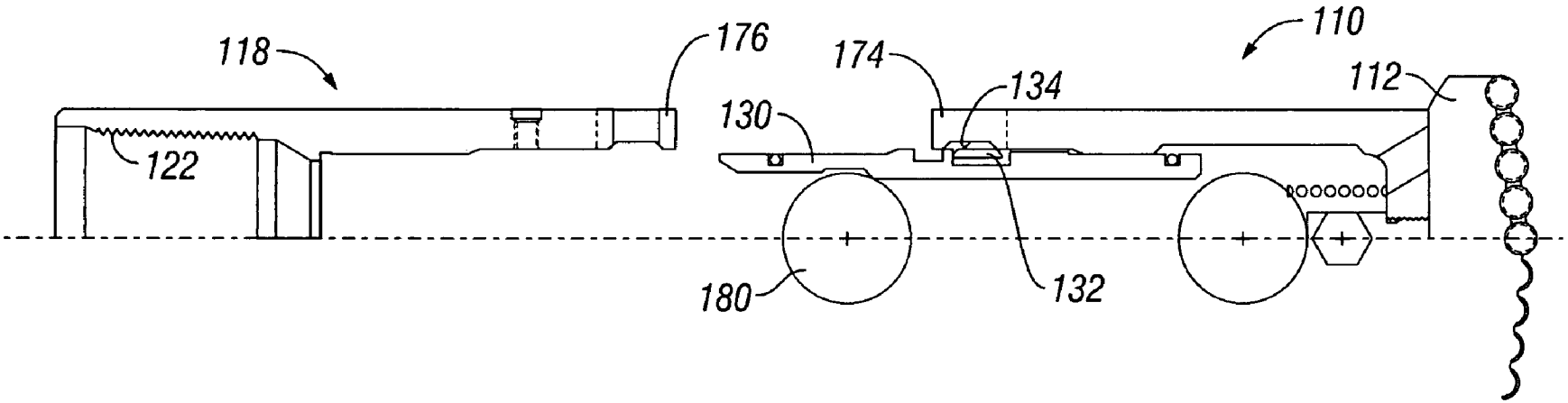
FIG. 13 is a sectioned view drawing of the pump-off sub of FIG. 7 shown separated from a mill assembly in accordance with an embodiment of the present invention.

Referring briefly to FIG. 13, mill assembly 110 is separated and left behind in the borehole while work string connected to pump-off sub 118 is either retrieved or used to perform additional functions. For example, in the instance where mill assembly 110 is used to remove a bridge plug separating a production zone from an upper zone, after bridge plug is removed, pump off sub 118 can be separated from mill assembly 110 and the work string can be used to complete the well and produce all of the zones.

Various other advantages of embodiments of the present invention will be realized and understood by ones of skill in the art. Particularly, the combination mill with pump-off sub reduces the complexity of milling operations. An integral mill an pump-off sub allows for a reduction in the total tool length as no threaded connection between pump off sub and mill is necessary. Furthermore, the serrated mill cutters have the advantage of higher penetration rates than downhole mills of the prior art. Particularly, the cutting surfaces of former mills include a coating of crushed carbide rather than serrated tungsten carbide blades. Whereas the serrated blades cut the plug (or other device) to be removed, the crushed carbide mills merely grind the plug. Finally, the c-ring pump-off subs in accordance with the present invention are advantageous over their prior-art ball bearing counterparts in that the bearing area of the locking mechanism is substantially increased. Furthermore, unlike ball bearing pump-off subs that experience forces urging separation throughout their operation, the larger surface areas of c-ring pump off subs distribute and thus significantly reduce forces prior to the dropping of the weighted ball down the drill-string. These reduced separation forces make c-ring pump-off subs more reliable than ball bearing pump-off subs.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole mill, comprising:

a mill body providing a cutting face, a rotation axis, and a gage diameter;

a plurality of cutters positioned upon the cutting face, wherein each cutter extends generally radially from a center region of the cutting face to the gage diameter, wherein;

the plurality of cutters includes a first serrated cutter blade having a plurality of peaks and valleys along its length;

the plurality of cutters includes a second serrated cutter blade having a plurality of peaks and valleys along its length; and the plurality of cutters includes a non-serrated cutter blade.

2. The downhole mill of claim 1, wherein the non-serrated cutter blade is positioned upon the cutting face between the first serrated cutter blade and second serrated cutter blade.

3. The downhole mill of claim 1, wherein the peaks of the first serrated cutter blade are radially aligned with the valleys of the second serrated cutter blade when the cutting head is rotated about the rotation axis.

4. The downhole mill of claim 1, further comprising a pump off sub releasably connected to a proximal end of the mill body.

5. The downhole mill of claim 4, wherein the pump off sub is configured to be detached from the mill body when a latch mandrel is displaced.

6. The downhole mill of claim 5, wherein the latch mandrel is configured to be displaced when a ball is dropped down a work string attached to a proximal end of the pump off sub.

7. The downhole mill of claim 1, wherein the first serrated cutter blade extends from the rotation axis to the gage diameter of the mill body.

8. The downhole mill of claim 1, wherein the non-serrated cutter blade extends from the rotation axis to the gage diameter of the mill body.

9. The downhole mill of claim 1, wherein the plurality of cutters includes four cutters.

10. The downhole mill of claim 1, wherein the plurality of cutters includes six cutters.

11. The downhole mill of claim 10, wherein the plurality of cutters further includes a second non-serrated cutter.

12. The downhole mill of claim 1, wherein the cutting face is convex.

13. The downhole mill of claim 1, wherein the cutting face is concave.

14. The downhole mill of claim 1, wherein the plurality of cutters is configured to drill out a downhole bridge plug.

15. The downhole mill of claim 1, further comprising a check valve in the mill body to prevent fluid flow from the cutter face to the internal cavity through a plurality of hydraulic ports.

16. The downhole mill of claim 1, wherein the non-serrated cutter blade has a different cutting height than the first and the second serrated cutters.

17. The downhole mill of claim 16, wherein the non-serrated cutter blade has a cutting height below the cutting height of the peaks of the first serrated and second serrated cutters.

18. The downhole mill of claim 16, wherein the non-serrated cutter blade has a cutting height above the cutting height of the peaks of the first serrated and second serrated cutters.

19. The downhole mill of claim 1, further comprising hardened button wear pads at the gage diameter.

20. The downhole mill of claim 1, wherein the first and second serrated cutters comprise tungsten carbide.

21. The downhole mill of claim 1, wherein the non-serrated cutter blade comprises tungsten carbide.

22. The downhole mill of claim 1, wherein the pitch of the first and the second serrated cutter blades is substantially the same.

23. The downhole mill of claim 1, wherein the non-serrated blade extends radially beyond the first and the second serrated cutter blades.

24. The downhole mill of claim 23, wherein the non-serrated blade extends radially beyond the first and the second serrated cutter blades by 0.125 inches.

25. A downhole mill, comprising:

a mill body providing a cutting face, a rotation axis, and a gage diameter;

a plurality of cutters positioned upon the cutting face, wherein each cutter extends generally radially from a center region of the cutting face to the gage diameter, wherein;

the plurality of cutters includes a first serrated cutter blade having a plurality of peaks and valleys along its length; and the plurality of cutters includes a second serrated cutter blade having a plurality of peaks and valleys along its length;

the plurality of cutters includes a non-serrated cutter blade positioned upon the cutting face between the first serrated cutter blade and second serrated cutter blade; and the peaks of the first serrated cutter blade are radially aligned with the valleys of the second serrated cutter blade when the cutting head is rotated about the rotation axis.

26. The downhole mill of claim 25, further comprising a pump off sub releasably connected to a proximal end of the mill body.

27. The downhole mill of claim 26, wherein the pump off sub is configured to be detached from the mill body when a latch mandrel is displaced.

28. The downhole mill of claim 27, wherein the latch mandrel is configured to be displaced when a ball is dropped down a work string attached to a proximal end of the pump off sub.

29. The downhole mill of claim 25, wherein the non-serrated cutter blade has a cutting height below the cutting height of the peaks of the first serrated and second serrated cutters.

30. A pump-off sub configured to release a downhole mill, the pump-off sub comprising:

a dovetail connection between the pump-off sub and the downhole mill, wherein the dovetail connection is maintained by a c-ring in an expanded state;

a latch mandrel slidably engaged within a bore of the downhole mill, the latch mandrel configured to maintain the c-ring in the expanded state with a radial upset;

the latch mandrel including a receptacle into which the c-ring is configured to collapse when in a collapsed state; and the c-ring progressing from the expanded state to the collapsed state when the latch mandrel is axially displaced by a ball dropped down the bore of a work string connected to a proximal end of the pump-off sub.

31. The pump-off sub of claim 30, wherein the downhole mill comprises:

a mill body providing a cutting face, a rotation axis, and a gage diameter; and a plurality of cutters positioned upon the cutting face, wherein each cutter extends generally radially from a center region of the cutting face to the gage diameter.

32. The pump-off sub of claim 31, wherein:

the plurality of cutters includes a first serrated cutter blade having a plurality of peaks and valleys along its length;

the plurality of cutters includes a second serrated cutter blade having a plurality of peaks and valleys along its length;

the plurality of cutters includes a non-serrated cutter blade positioned upon the cutting face between the first serrated cutter blade and second serrated cutter blade; and the peaks of the first serrated cutter blade are radially aligned with the valleys of the second serrated cutter blade when the cutting head is rotated about the rotation axis.

33. The pump-off sub of claim 30 wherein the downhole mill is configured to cut a bridge plug.

34. The pump-off sub of claim 30, wherein the latch mandrel is slidably engaged within a bore of the pump-off sub.

35. A pump-off sub configured to release the downhole mill of claim 1, the pump-off sub comprising:

a detachable connection between the pump-off sub and the downhole mill, wherein the detachable connection is maintained by a c-ring in an expanded state;

a latch mandrel slidably engaged within a bore of the pump-off sub, the latch mandrel configured to maintain the c-ring in the expanded state with a radial upset;

the latch mandrel including a receptacle into which the c-ring is configured to collapse when in a collapsed state; and the c-ring progressing from the expanded state to the collapsed state when the latch mandrel is axially displaced by a ball dropped down the bore of a work string connected to a proximal end of the pump-off sub.

36. The pump-off sub of claim 35 wherein the downhole mill is configured to cut a bridge plug.

37. A method to remove a downhole obstruction with a mill, comprising:

connecting the mill to a distal end of a pump-off sub;

deploying the pump-off sub and connected mill to the downhole obstruction upon a distal end of a work string;

rotating and axially loading the mill against the downhole obstruction;

dropping a weighted ball down the work string to disengage a latch mandrel and retract a c-ring of the pump-off sub; and axially loading the work string to separate the pump-off sub from the detached mill.

38. The method of claim 37, wherein the downhole obstruction is a bridge plug.

39. The method of claim 38, wherein the bridge plug isolates a production zone from an upper zone.

40. The method of claim 39, further comprising retrieving production fluids from the production zone through the detached work string.

41. The method of claim 37, wherein the mill comprises a plurality of cutters extending generally radially from a center region of a cutting face to a gage diameter.

42. The method of claim 41, wherein:

the plurality of cutters includes a first serrated cutter blade having a plurality of peaks and valleys along its length;

the plurality of cutters includes a second serrated cutter blade having a plurality of peaks and valleys along its length; and the peaks of the first serrated cutter blade are radially aligned with the valleys of the second serrated cutter blade when the cutting head is rotated about a rotation axis.

43. The method of claim 42, wherein the plurality of cutters includes a non-serrated cutter blade positioned upon the cutting face between the first serrated cutter blade and second serrated cutter blade.

* * * * *